United States Patent [19]

Clayton

[11] 4,198,709

[45] Apr. 22, 1980

[54] BOWLING GLOVE

[76] Inventor: Donald D. Clayton, 2426 8th Ave., North Great Falls, Mont. 59401

[21] Appl. No.: 929,922

[22] Filed: Aug. 1, 1978

[51] Int. Cl.[2] ..... A41D 13/10; A63B 71/14

[52] U.S. Cl. ..... 2/161 A; 273/54 B

[58] Field of Search ..... 2/16, 20, 21, 161 A, 2/162, 163, 166; 273/54 B; 272/119; 128/165

[56] References Cited

U.S. PATENT DOCUMENTS

| | | | |
|---|---|---|---|
| 1,469,315 | 10/1923 | Hansard | 2/161 A |
| 2,949,610 | 8/1960 | Lutsky | 2/161 A |
| 3,038,723 | 6/1962 | Bergendorf | 2/161 A |
| 3,467,379 | 9/1969 | Kistner | 2/161 A |
| 3,704,994 | 12/1972 | Krzewinski et al. | 2/161 A |
| 3,728,738 | 4/1973 | Andolino | 2/161 A |

*Primary Examiner*—Louis Rimrodt
*Attorney, Agent, or Firm*—Arthur L. Urban

[57] ABSTRACT

A bowling glove including an appendage portion extending from the back portion along the back of the index finger for substantially the entire length thereof, a first elongated pocket extending from an opening at the free edge of the wrist encircling portion along the palm portion and partially around the thumb opening, a first thin bar member disposed within the first pocket along substantially the entire length thereof with one edge extending partially around the thumb receiving opening, a second elongated pocket extending from an opening at the free edge of the wrist encircling portion along the center of the back portion and offset along substantially the entire length of the appendage portion, and a second thin bar member disposed within the second pocket along substantially the entire length thereof, the first bar member having a transverse bend adjacent the wrist joint and the second bar member having a transverse bend adjacent the wrist joint and a transverse bend adjacent the base of the index finger.

11 Claims, 6 Drawing Figures

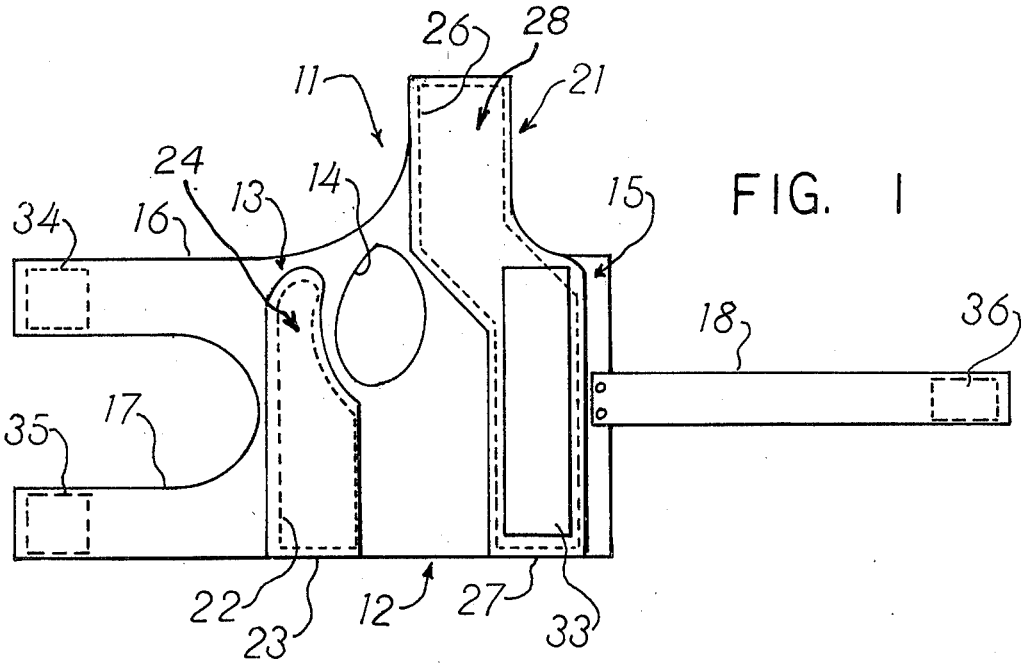
FIG. 1
FIG. 2
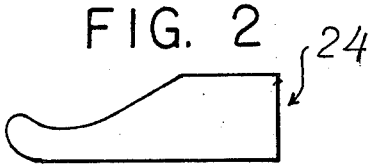
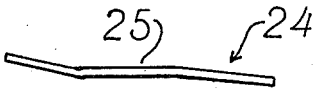
FIG. 3
FIG. 4
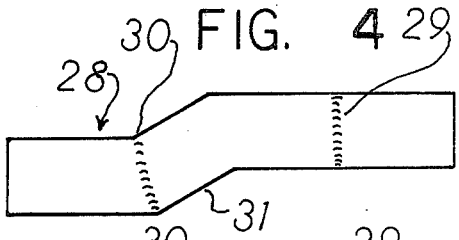
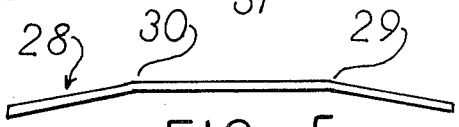
FIG. 5
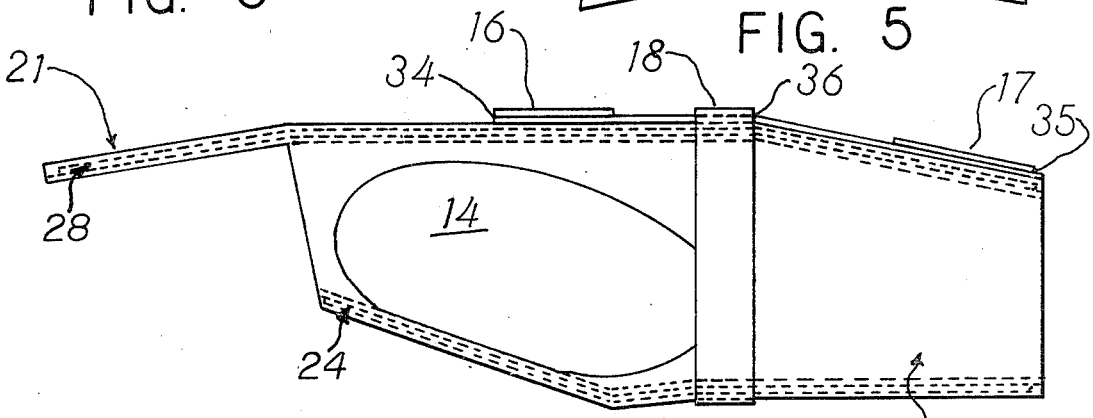
FIG. 6

BOWLING GLOVE

This invention relates to a novel glove for use by bowlers and more particularly relates to a glove which provides a bowler with greater control in the delivery of a bowling ball.

With the increase in the popularity of the sport of bowling, a great deal of attention has been given to ways of improving a bowler's score. Generally, this involves instruction in proper bowling techniques. Also, the type and fit of the equipment such as the ball and shoes have a significant effect on scoring. In addition, a bowler must spend considerable time practicing in order to develop his game.

Although many bowlers have taken instruction, are using proper equipment and diligently practice, they still are unable to attain their full potential because of other factors. For example, a bowler may lack sufficient strength to control the ball during delivery. Other bowlers find that while they have good control of the ball in early games, they lack the physical stamina to retain this control throughout an extended series. Still others find their ball control varies frame to frame.

A variety of solutions have been proposed to the problem of achieving better control of a bowling ball during delivery. Some bowlers change their grip of the ball while others use gloves to stiffen their wrists. Although these expedients may provide an improvement in a bowler's game, they still do not give a bowler the high degree of ball control during delivery which he desires and requires.

Gloves that are presently available tend to transfer stress and forces generated during delivery to the bowler's hand with the result that the hand and fingers tire more easily. This tiredness adversely affects the ability of a bowler to control the delivery of his ball. In view of the shortcomings of gloves and other equipment now being offered to improve ball control, bowlers continue to search for a means of achieving better control of a bowling ball during delivery.

The present invention provides a novel glove which enables a bowler to maintain better control of his ball during delivery. The glove of the invention not only provides stiffening of the bowler's wrist, but also provides support for the hand and fingers. In addition, the bowling glove assists in maintaining proper alignment of the wrist, hand and fingers during delivery of the ball.

Another advantage of the bowling glove of the present invention is the simplicity of its design. Also, the glove can be fabricated in a variety of colors and textures from commercially available materials relatively inexpensively. Further, the design of the glove enables a bowler to adjust the configuration of the various portions thereof to achieve a comfortable fit with the desired stiffness and support of the wrist, hand and fingers.

Other benefits and advantages of the novel bowling glove of the present invention will be apparent from the following description and the accompanying drawings in which:

FIG. 1 is a top view of one form of the bowling glove of the invention in an open flat position;

FIG. 2 is a top view of the first bar member of the bowling glove shown in FIG. 1;

FIG. 3 is an edge view of the first bar member shown in FIG. 2;

FIG. 4 is a top view of the second bar member of the bowling glove shown in FIG. 1;

FIG. 5 is an edge view of the second bar member shown in FIG. 4; and

FIG. 6 is a side view partially in section of the bowling glove shown in FIG. 1 in a closed, hand encircling position.

As shown in the drawings, one form of the novel bowling glove 11 of the invention includes a wrist encircling portion 12 with a palm portion 13 extending therefrom. Palm portion 13 has a thumb receiving opening 14 adjacent one side thereof. A back of the hand portion 15 also extends from wrist encircling portion 12 and from the side of palm portion 13 which is adjacent to the thumb receiving opening 14.

Connecting means shown as straps 16, 17 and 18 are provided to hold the glove 11 in a closed position surrounding the bowler's hand. Strap 16 connects the free side of the palm portion 13 which is remote from thumb opening 14 with the free side of the back portion 15 that is remote from the thumb opening also. Likewise, strap 17 connects the wrist encircling portion 12 with itself and strap 18 extending from back portion 15 encircles the glove between the palm portion 13 and the wrist portion 12.

Palm portion 13 extends toward the base of the bowler's fingers. Back of the hand portion 15 extends toward the base of the bowler's fingers with an appendage portion 21 extending therefrom along the back of the index finger (not shown). The appendage portion 21 extends along substantially the entire length of the index finger. Thus, the glove of the invention as shown extends from above the wrist to a point adjacent the base of the fingers with appendage portion 21 extending along the back of the index finger.

Glove 11 includes a first elongated pocket or slot 22 which extends from an opening 23 at the free edge of the wrist portion 12 into the palm portion 13 to a point adjacent to the thumb opening 14. A first thin bar member 24 is disposed within the pocket 22 along substantially the entire length thereof with one edge of the bar member extending partially around the thumb opening 14. First bar member 24 advantageously has a transverse bend adjacent to the wrist joint, shown as a compound bend 25 which fits the heel of the bowler's hand.

The glove 11 also includes a second elongated pocket or slot 26 which extends from an opening 27 at the free edge of wrist portion 12 through the wrist portion and the back portion 15 and along substantially the entire length of appendage portion 21.

A second thin bar member 28 is disposed within the second pocket 26 along substantially the entire length thereof. The second bar member 28 has a transverse bend 29 (FIG. 5) adjacent the wrist joint of the hand and a second transverse bend 30 adjacent the base of the index finger. Second bar member 28 also has a diagonal section 31 connecting and offsetting the finger backing part of the member with respect to the main part of the member which is disposed along the center of the back portion 15.

Advantageously, the transverse bends 29 and 30 are in the same direction as shown in FIG. 5 at a small angle between about 5° and 15° and preferably between about 8° and 12°. The first and second bar members 24 and 28, respectively, preferably are formed of thin metal bar stock having a width between about one and two inches and particularly between about one and one-fourth and one and three-fourths inches. The thickness may be from about one-sixteenth to one-eighth inch with the second bar member being heavier. The lengths of the bar members will depend to a large extent upon the size of the glove which in turn depends upon the hand of the bowler. A man's glove may have a first bar member 24 about five to five and one-half inches long and a second bar member 28 about nine inches long. A nine inch second bar member may have a finger portion about two and one-fourth inches long, a hand portion about four inches long and a wrist portion about two and three-fourths inches long. If desired, one side of the second bar member may be cut out to accommodate the protrusion of the wrist bones.

The connecting means for holding the glove 11 on the hand of the bowler as mentioned above includes straps 16, 17 and 18. Buckles or other fastening means may be employed for this purpose, although it is preferred as shown to utilize fasteners of the Velcro type in which napped fabric pads mate with hook fabric pads. For example, a napped pad 33 may be attached to back portion 15 and hook pads 34, 35 and 36 may be secured to straps 16, 17 and 18, respectively. Fasteners of this type provide an infinite adjustment of the straps to control the tightness of the glove.

In addition to adjusting the tightness of the straps 16, 17 and 18, the fit of the glove 11 may be adjusted by changing location and/or angle of the transverse bends 25 and 29 and 30 in the first and second bar members 24 and 28. This can be accomplished by bending the bar members while they are disposed within pockets 22 and 26 or more advantageously by removing the bar members from their respective pockets through the openings at the edge of the wrist portion 12. After being rebent the bar members may be replaced in the pockets and the openings closed and sealed again. In some situations, it also may be desirable to shorten or reduce the width of the bar members prior to reinserting the bars into the pockets.

The above description and the accompanying drawings show that the present invention provides a novel glove for bowlers which enables them to maintain better control of their bowling balls during delivery. The glove of the invention provides support for the hand and fingers as well as for the wrist. Also, the bowling glove provides assistance in maintaining proper alignment of the wrist, fingers and hand during delivery of the ball.

The bowling glove of the present invention also is simple in design. Furthermore, the glove can be fabricated from commercially available materials such as leather, plastic, fabric and similar glove materials. The bar members may formed of plastic, rubber and similar materials, although metals such as steel, aluminum, etc. are preferable. The use of the above materials in the bowling glove design of the invention allows a bowler to adjust the shape of the various parts of the glove in order to achieve a comfortable fit with the desired stiffness and support of the wrist, hand and fingers.

It will be apparent that various modifications can be made in the particular bowling glove design described in detail above and shown in the drawings within the scope of the invention. For example, the pockets may be formed by stitching pieces to the main glove structure as shown or may be formed by utilizing a double layer of material over part or all of the glove portions. Also, the size and configuration of the various portions of the glove may be changed for particular hand shapes and sizes. Therefore, the scope of the invention is to be limited only by the following claims.

What is claimed is:

1. A bowling glove including a wrist encircling portion, a palm portion extending from said wrist encircling portion and having a thumb receiving opening, a back of the hand portion extending from said wrist encircling portion and connected to the palm portion adjacent to said thumb opening, means for maintaining the free side of said palm portion which is remote from said thumb opening adjacent to the free side of said back portion which is remote from said thumb opening and for maintaining said wrist encircling portion in contact with itself, said palm portion extending toward the base of the fingers, said back portion extending toward the base of the fingers, an appendage portion extending from said back portion along the back of the index finger for substantially the entire length thereof, a first elongated pocket extending from an opening at the free edge of said wrist portion along said palm portion and partially around said thumb opening, a first thin bar member disposed with said first pocket along substantially the entire length thereof with one edge extending partially around said thumb opening, a second elongated pocket extending from an opening at the free edge of said wrist portion along the center of said back portion and offset along substantially the entire length of said appendage portion, and a second thin bar member disposed within said second pocket along substantially the entire length thereof, said second bar member having a transverse bend adjacent the wrist joint and a transverse bend adjacent the base of the index finger.

2. A bowling glove according to claim 1 wherein said first bar member has a transverse bend adjacent to the wrist joint.

3. A bowling glove according to claim 1 wherein said transverse bends of said second bar member are in the same direction.

4. A bowling glove according to claim 1 wherein said transverse bends of said second bar member are between about 5° and 15°.

5. A bowling glove according to claim 1 wherein said transverse bends of said second bar member are between about 8° and 12°.

6. A bowling glove according to claim 1 wherein said first and second bar members are formed of metal.

7. A bowling glove according to claim 1 wherein said wrist encircling portion, said palm portion, said back portion and said appendage portion form a single unit.

8. A bowling glove according to claim 1 wherein said first and second pockets are formed from overlays attached to the outside of said palm portion and said back portion.

9. A bowling glove according to claim 1 wherein said openings of said first and second pockets are closed to retain said first and second bar members therein.

10. A bowling glove according to claim 1 wherein said means for maintaining the free sides of said palm portion and said back portion adjacent includes straps and fastening means.

11. A bowling glove according to claim 10 wherein said fastening means includes a combination of napped fabric pads and mating hook fabric pads with one set of pads on said connecting straps and the other on the outside of said second pocket.

* * * * *